US009012114B2

(12) United States Patent
Mizutani et al.

(10) Patent No.: US 9,012,114 B2
(45) Date of Patent: Apr. 21, 2015

(54) ELECTROSTATIC CHARGE IMAGE DEVELOPING TONER, ELECTROSTATIC CHARGE IMAGE DEVELOPER, AND TONER CARTRIDGE

(71) Applicant: Fuji Xerox Co., Ltd., Tokyo (JP)

(72) Inventors: Noriyuki Mizutani, Kanagawa (JP); Tsuyoshi Murakami, Kanagawa (JP); Yukiaki Nakamura, Kanagawa (JP); Satoshi Kamiwaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 43 days.

(21) Appl. No.: 14/048,718

(22) Filed: Oct. 8, 2013

(65) Prior Publication Data

US 2014/0193750 A1 Jul. 10, 2014

(30) Foreign Application Priority Data

Jan. 10, 2013 (JP) ..... 2013-002810

(51) Int. Cl.

| | |
|---|---|
| ***G03G 9/08*** | (2006.01) |
| ***G03G 9/087*** | (2006.01) |
| ***G03G 9/097*** | (2006.01) |

(52) U.S. Cl.

CPC ..... *G03G 9/08755* (2013.01); *G03G 9/09741* (2013.01); *G03G 9/09733* (2013.01); *G03G 9/0819* (2013.01); *G03G 9/0827* (2013.01); *G03G 9/08782* (2013.01); *G03G 9/09775* (2013.01)

(58) Field of Classification Search

CPC ..... G03G 9/09741; G03G 9/09775
USPC ..... 430/108.2, 108.22
See application file for complete search history.

(56) References Cited

FOREIGN PATENT DOCUMENTS

JP A-2012-48014 3/2012

*Primary Examiner* — Mark A Chapman
(74) *Attorney, Agent, or Firm* — Oliff PLC

(57) ABSTRACT

An electrostatic charge image developing toner includes toner particles; and an external additive that is externally added to surfaces of the toner particles, in which a content of nitrogen atoms on the surfaces of the toner particles is from 0.8 atomic % to 5.0 atomic % and a content of nitrogen atoms at a depth of 10 nm inside from the surfaces of the toner particles is 0.4 atomic % or less when measured by X-ray photoelectron spectroscopy.

16 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2013-002810 filed Jan. 10, 2013.

BACKGROUND

1. Technical Field

The present invention relates to an electrostatic charge image developing toner, an electrostatic charge image developer, and a toner cartridge.

2. Related Art

In recent years, an electrophotographic process has been widely used not only in copying machines but also in printers such as network printers in offices, printers for personal computers and printers for on-demand printing, as information instruments have been developing and communication networks have been making progress in information society. Such characteristics have been more strongly required as high image quality, high speed, high reliability, compactness, lightness, and energy-saving in both fields of monochromic and color electrophotographic processes.

In the electrophotographic process, a fixed image is usually formed through plural processes of forming an electrostatic charge image on a photoreceptor (image holding member) using a photoconductive material by means of various units, using a toner to develop the charge image, transferring the toner image on the photoreceptor, through an intermediate transfer member or without an intermediate transfer member, onto a recording medium such as a sheet of paper, and then fixing the transferred image onto the recording medium.

SUMMARY

According to an aspect of the invention, there is provided an electrostatic charge image developing toner including toner particles; and an external additive that is externally added to surfaces of the toner particles, wherein a content of nitrogen atoms on the surfaces of the toner particles is from 0.8 atomic % to 5.0 atomic %, and a content of nitrogen atoms at a depth of 10 nm inside from the surfaces of the toner particles is 0.4 atomic % or less when measured by X-ray photoelectron spectroscopy.

BRIEF DESCRIPTION OF THE DRAWINGS

Exemplary embodiments of the present invention will be described in detail based on the following figures, wherein.

DETAILED DESCRIPTION

Figure 1:
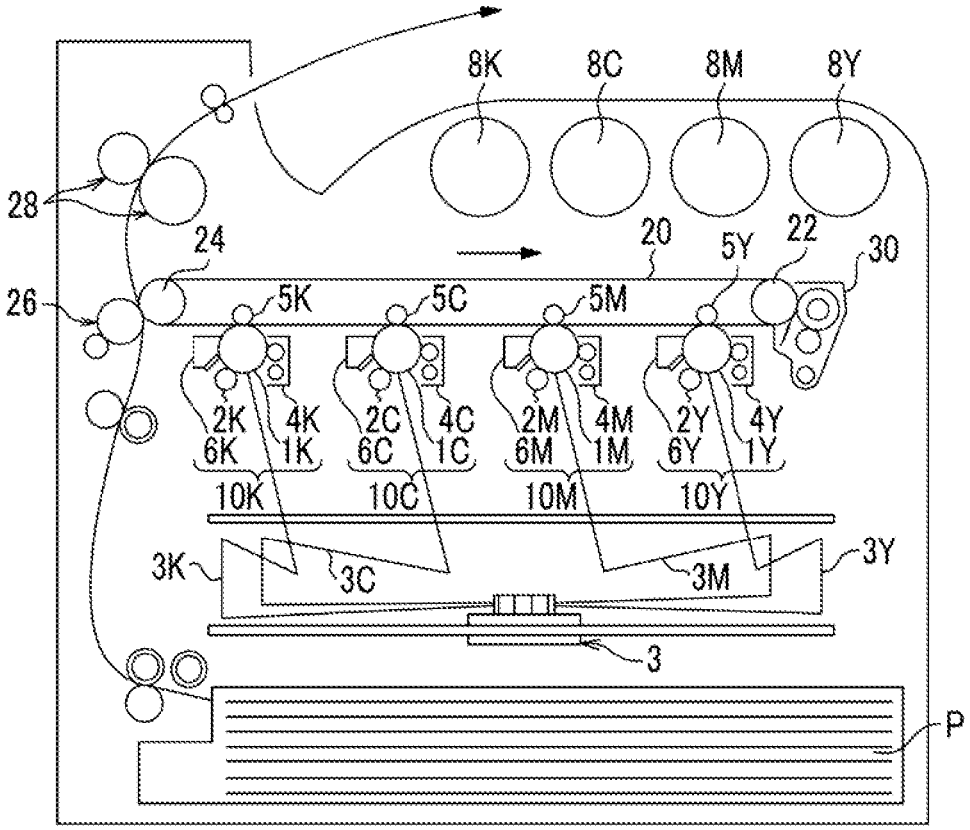
FIG. 1 is a configuration diagram schematically showing an example of an image forming apparatus according to an exemplary embodiment.

Exemplary embodiments of an electrostatic charge image developing toner, an electrostatic charge image developer, a toner cartridge, a process cartridge, an image forming apparatus, and an image forming method according to the invention will, foe hereunder described in detail.

Electrostatic Charge Image Developing Toner

The electrostatic charge image developing toner according to the exemplary embodiment (hereinafter, also referred to as "toner according to the present exemplary embodiment") includes toner particles and an external additive which is externally added to the surfaces of the toner particles, in which a content of nitrogen atoms on the surfaces of the toner particles is from 0-8 atomic % to 5.0 atomic % and a content of nitrogen atoms at a depth of 10 nm inside from the surfaces of the toner particles is 0.4 atomic % or less when measured by X-ray photoelectron spectroscopy.

When printing is continuously performed in a high humidity (90% RH or more) environment, the temperature of a developing unit and the developer is increased due to fractional heat by the driving of a developer unit and heat from a fuser in some cases, particularly in a small image forming apparatus. In this case, the amount of the toner and the developer charged is increased by lowering the relative temperature, and then, a decrease in solid density and in-plane unevenness occur in some cases.

As a result of intensive research, the inventors have found that when the inside temperature of the developer unit is increased and the relative temperature is decreased, by providing the predetermined amount of nitrogen atoms on the surfaces of the toner particles, a variation in charging of the toner becomes mild and thus, an image defect such as a decrease in image density or occurrence of in-plane unevenness in the image is prevented without causing fogging.

Since nitrogen atoms originally easily adsorb water, it is considered that nitrogen atoms present on the outermost surfaces of the toner particles adsorb water in a molecular state. The water adsorbed in a molecular state does not rapidly evaporate even when the relative temperature is decreased. As a result, it is possible to maintain a state of keeping a predetermined level of humidity in the vicinity of the surface of the toner. Therefore, it is considered that a variation in the charged amount becomes mild.

In the exemplary embodiment, the content of nitrogen atoms on the surfaces of the toner particles is measured by X-ray photoelectron spectroscopy. In the exemplary embodiment, the content of nitrogen atoms on the surfaces of the toner particles is from 0.8 atomic % to 5.0 atomic %, preferably irons 0.8 atomic % to 4.5 atomic % and more preferably from 0.9 atomic % to 4.0 atomic %. By setting the surface nitrogen amount to the aforementioned range, even when the relative temperature is more rapidly decreased, the humidity in the vicinity of the surfaces of the toner particles is prevented from being changed and a favorable solid image formation may be maintained, even when printing is continuously performed under a high humidity condition.

When the content of nitrogen atoms on the surfaces of the toner particles is less than 0.8 atomic %, the amount of moisture adsorbed on the surfaces of the toner particles is not sufficient, an effect of preventing a change in humidity in the vicinity of the toner particle is not sufficient and a variation in the charged amount becomes great. Therefore, a density decrease occurs in some cases. When the content of nitrogen atoms on the surfaces of the toner particles is more than 5.0 atomic %, contrarily, the amount of moisture adsorbed on the surfaces of the toner particles is increased, the charged amount itself is decreased. Particularly, fogging easily occurs in a high temperature and high humidity environment.

In addition, it is preferable that the nitrogen atoms be present on the outermost surfaces of the toner particles and not present inside the toner particle as much as possible. This is because the amount of the toner charged is determined on the outermost surface of the toner and the nitrogen present in the depth direction of the toner particle and the moisture adsorbed onto the nitrogen do not contribute to charging. Further, the moisture present in the depth direction is not easily dehydrated once adsorbed. Therefore, after the toner is kept in a high humidity environment for a long period of time, electrical properties are deteriorated and particularly, a deterioration in a black toner is remarkable in some cases.

In the exemplary embodiment, it is necessary that the content of nitrogen atoms at a depth of 10 nm inside from the surfaces of the toner particles be 0.4 atomic % or less since a deterioration in transferring properties and fogging do not occur even after the toner is kept in a high humidity environment for a long period of time and a favorable image is formed. When the content of nitrogen atoms at a depth of 10 nm inside from the surfaces of the toner particles is 0.3 atomic % or less, the content is preferable since a more favorable image is formed.

In the exemplary embodiment, the measuring condition of X-ray photoelectron spectroscopy performed for measuring the content of nitrogen atoms is as follows.

Apparatus used: 1600S X-ray photoelectron spectroscope (manufactured by Physical Electronics Industries, Inc.)

Measuring condition: X-ray source MgKα (400 W)

Spectroscopic area: diameter of 800 μm

In the exemplary embodiment, a method of cutting the surfaces of the toner particles is not particularly limited and any method may be employed as long as a depth of 10 nm inside from the surface Of the toner particle is cut without modifying the toner material.

In the exemplary embodiment, for example, using an Ar etching method, the surfaces of the toner particles are cut by Ar etching and the surface nitrogen amount is measured each time to confirm the content of nitrogen atoms at a depth of 10 nm inside from the surfaces of the toner particles. For example, the Ar etching is performed for 80 seconds under the conditions of an Ar gas pressure of $3.0\times10^{-2}$ Pa and an accelerating voltage of 400 V.

In the exemplary embodiment, the content of nitrogen atoms is a value with respect to the toner particle and is different from the content of nitrogen atoms in a state in which an external additive is externally added to the toner particle. This is because there is a case in which nitrogen atoms are attached to or contained in the external additive, and the content of nitrogen atoms with respect to the toner to which the external additive is externally added may be different from the content of nitrogen atoms with respect to the toner particle before the external additive is externally added.

In the exemplary embodiment, as a method, of removing the external additive from the toner to which the external additive is externally added, for example, the following method may be used.

The toner to which the external additive is externally added is dispersed in a 0.2% by weight of aqueous solution of polyoxyethylene (10) octyl phenyl ether so as to have an amount of 10% by weight and ultrasonic vibration (frequency: 20 KHz, output: 30 W) is applied for 60 minutes while keeping a temperature of 30° C. or less to separate the external additive. It is possible to obtain toner particles from which the external additive is removed by separating the toner particles from the dispersion through filtration and washing the toner particles.

Each component forming a toner according to an exemplary embodiment will be described below in detail.

The toner according to the exemplary embodiment includes toner particles and an external additive which is externally added to the surfaces of the toner particles.

Toner Particles

The toner particles contain, for example, a binder resin, and as necessary, a colorant, and a release agent and other additives.

Binder Resin

Examples of the binder resin, include vinyl resins made of homopolymers of monomers such as styrenes (for example, styrene, parachlorostyrene and α-methylstyrene), (meth) acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate), ethylenic unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone and vinyl isopropenyl ketone), and olefins (for example, ethylene, propylene and butadiene), and copolymers of two kinds or more of these monomers combined.

Examples of the binder resin include non-vinyl resins such as epoxy resins, polyester resins, polyurethane resins, polyamide resins, cellulose resins, polyether resins, modified rosins, mixtures of the non-vinyl resins with the above vinyl resins, and graft polymers obtained by polymerizing the above vinyl monomers under a coexistence of the above non-vinyl resins.

These binder resins may be used singly or in combination of two or more kinds.

As the binder resin, the polyester resins are preferable.

Examples of the polyester resins include known amorphous polyester resins.

Polyester Resin

An example of the polyester resin includes a condensation polymer of a polyvalent carboxylic acid and a polyol. In addition, as the polyester resin, commercially available products may be used, or synthetic resins may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkyenyl succinic acid, adipic acid and sebacic acid), alicyclic dicarboxylic acids (for example, cyclohexane dicarboxylic acid), aromatic dicarboxylic acids (for example, terephthalic acid, isophthalic acid, phthalic acid, and naphthalene dicarboxylic acid) and anhydrides and lower alkyl esters (for example, those having a carbon number of from 1 to 5) thereof. Among these polyvalent carboxylic acids, for example, aromatic dicarboxylic acids are preferably used.

As the polyvalent carboxylic acids, a trivalent or higher valent carboxylic acid which has a crosslinked structure or a branched structure may be used with dicarboxylic acids. Examples of the trivalent or higher valent carboxylic acid include trimellitic acid, pyromellitic acid, and anhydrides and lower alkyl esters (for example, those having a carbon number of from 1 to 5) thereof.

These polyvalent carboxylic acids may foe used singly or in combination of two or more kinds.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol and hydrogen-added bisphenol A) and aromatic diols (for example, ethylene oxide adduces of bisphenol A and propylene oxide adducts of bisphenol A).

Among these polyols, for example, aromatic diols and alicyclic diols are preferably used, and aromatic diols are more preferably used.

As the polyols, a trivalent or higher valent polyol which has a cross-linked structure or a branched structure may be used with diols. Examples of the trivalent or higher valent polyol include glycerin, trimethylolpropane, and pentaerythritol.

These polyols may be used singly or in combination of two or more kinds.

The glass transition temperature (Tg) of the polyester resin is preferably from 50° C. to 80° C. and more preferably from 50° C. to 65° C.

In addition, the glass transition temperature is calculated from a DSC curve obtained from differential scanning calorimetry (DSC) and more specifically, the glass transition temperature is calculated according to "extrapolated glass transition starting temperature" described in a method of calculating glass transition temperature in "Testing methods for transition temperatures of plastics" of JIS K-1987.

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.3 to 100, and more preferably from 2 to 60.

The weight average molecular weight and the number average molecular weight are measured by gel permeation chromatography (GPC). The GPC molecular weight measurement is performed using GPC HLC-8120 (manufactured by Tosoh Corporation) as a measurement device and TSK gel Super HM-M (15 cm) (manufactured by Tosoh Corporation) as a column with THF as a solvent. The weight average molecular weight and the number average molecular weight are calculated using a molecular weight calibration curve prepared using a monodispersed polystyrene standard sample from the measurement result.

The polyester resin may be produced using a known production method. Specifically, for example, there may be a method of preparing a polyester resin at a polymerization temperature in a range from 180° C. to 230° C. by reducing the pressure in the reaction system, as necessary, and reacting raw materials while removing water and alcohol generated daring condensation.

In addition, when raw material monomers are not dissolved or compatible with each other at the reaction temperature, a solvent having a high boiling point may be added thereto as a dissolution aid, in order to dissolve the monomers. In this case, the polycondensation reaction is performed while distilling the dissolution aid. When a monomer having a poor compatibility is present, in the copolymerization reaction, the polycondensation reaction may be performed with the main component after condensing the monomer having a poor compatibility with the acid or alcohol to be polycondensed with the monomer.

Colorant

Examples of the colorants include various kinds of pigments such as carbon black, chrome yellow, Hansa Yellow, Benzidine Yellow, Indanthrene Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine S Lake, Lake Red C, Pigment Red, Rose Bengal, Aniline Blue, Ultramarine Blue, Chalco Oil Blue, Methylene Blue Chloride, Phthalocyanine Blue, Pigment Blue, Phthalocyanine Green, and Malachite Green Oxalate, and various kinds of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes and thiazole dyes.

The colorants may be used singly or in combination of two or more kinds.

Regarding the colorant, as necessary, a surface-treated colorant may be used and a dispersant may be used in combination. In addition, various kinds of colorants may be used in combination.

For example, the content of the colorant is preferably, for example, from 1% by weight to 30% by weight and more preferably iron 3% by weight to 15% by weight with respect to the total amount of the toner particles.

Release Agent

Examples of the release agent include hydrocarbon wax; natural wax such as carnauba war, rice wax and candelilla wax; synthetic or mineral and petroleum wax such as montan wax; and ester wax such as fatty acid ester and montanic acid ester. However, there is no limitation thereto.

The melting temperature of the release agent is preferably from 50° C. to 110° C. and more preferably from 60° C. to 100° C.

In addition, the melting temperature is calculated from the DSC curve obtained from differential scanning calorimetry (DSC) according to a "melting peak temperature" described in a method of calculating melting temperature in "Testing methods for transition temperatures of plastics" of JIS K-1987.

The content of the release agent is preferably, for example, from 1% by weight to 20% by weight and more preferably from 5% by weight to 15% by weight with respect to the total amount of the toner particles.

Other Additives

Examples of the other additives include known additives such as a magnetic material, a charge-controlling agent, and an inorganic powder. These additives are contained in the toner particles as an internal additive.

Characteristics of Toner Particles and the Like

The toner particles may be toner particles having a single layer structure, or may be toner particles having a so-called core-shell structure constituted by a core (core particle) and a coating layer (shell layer) coating the core.

Here, the toner particles having a core-shell structure may be preferably constituted by the core containing a binder resin, and, as necessary, other additives such as a colorant and a release agent, and the coating layer containing a binder resin.

The volume average particle size (D50v) of the toner particles is preferably from 2 μm to 10 μm, and more preferably from 4 μm to 9 μm.

Various kinds of average particle sizes and particle size distribution indexes of the toner particles are measured using a Coulter multisizer II (manufactured by Bookman Coulter, Inc.). ISOTON-II (manufactured by Bookman Coulter, Inc.) is used as an electrolyte.

In the measurement, 0.5 mg to 50 mg of a measurement sample is added to 2 ml of a 5% surfactant (sodium alkyl benzene sulfonate is preferable) aqueous solution as a dispersant. The mixture is added to 100 ml to 1.50 ml of the electrolyte.

The electrolyte in which the sample is suspended is subjected to a dispersion treatment for 1 minute by an ultrasonic dispersing machine, and the Coulter multisizer II measures a particle size distribution of particles of from 2 μm to 60 μm by using an aperture having an aperture diameter of 100 μm. 50,000 particles are sampled.

A cumulative distribution is drawn from the smallest diameter side for the volume and the number with respect to particle size ranges (channels) divided on the basis of the particle size distributions measured in this manner. The particle sizes corresponding to 16% in the cumulative distributions are defined as a volume average particle size D16v and a number average particle size D16p, the particle slices corresponding to 50% in the cumulative distributions are defined as a volume average particle size D50v and a number average particle size D50p, and the particle sizes corresponding to 84% in the cumulative distributions are defined as a volume average particle size D84v and a number average particle size D84p.

Using these particle sizes, a volume average particle size distribution index (GSDv) is calculated as $(D84v/D16v)^{1/2}$ and a number average particle size distribution index (GSDp) is calculated as $(D84p/D16p)^{1/2}$.

The shape factor SF1 of the toner particle is preferably from 11.0 to 150 and more preferably from 120 to 140.

Here, the shape factor SF1 is obtained by the following Equation, $$SF1=(ML^2/A)\times(\pi/4)\times 100 \quad \text{Equation:}$$

In the equation, ML represents an absolute maximum length of the toner particle, and A represents a projected area of the toner particle.

Specifically, the shape factor SF1 is calculated as follows mainly using a microscopic image or an image of a scanning electron microscope (SEM) that is analyzed using an image analyzer to be digitalized. That is, an optical microscopic image of particles sprayed on the surface of a glass slide is scanned into an image analyzer LUZEX through a video camera, the maximum lengths and the projected areas of 100 particles are obtained for calculation using the above-described equation, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$ and $MgSO_4$.

It is advisable that the surfaces of the inorganic particles as the external additive are subjected to a hydrophobization treatment. For example, the hydrophobization treatment is performed, by immersing the inorganic particles in a hydrophobizing agent. The hydrophobizing agent is not particularly limited and examples thereof include a silane coupling agent, silicone oil, a titanate coupling agent and an aluminum coupling agent. These may be used singly or in combination of two or more kinds.

For example, the amount of the hydrophobizing agent is typically from 1 part by weight to 10 parts by weight with respect to 100 parts by weight of the inorganic particles.

Examples of the external additives also include resin particles (resin particles such as polystyrene, PMMA and melamine resin) and cleaning activators (for example, a metal salt of higher fatty acid represented by zinc stearate and a particle of a fluorine polymer having a high molecular weight).

The amount of the external additive externally added is, for example, preferably from 0.01% by weight to 5% by weight and more preferably from 0.01% by weight to 2.0% by weight with respect to the toner particles.

Method of Preparing Terser

Hereinafter, a method of producing a toner according to the exemplary embodiment will be described.

The toner according to the exemplary embodiment is obtained by externally adding an external additive to toner particles after the toner particles are produced.

The toner particles may be produced, by any of a dry production method (for example, kneading and pulverizing method) and a wet production method (for example, an aggregation and coalescence method, a suspension polymerization method and a dissolution suspension method). The method of preparing the toner particles is not limited thereto and a known method may be employed.

Among these, the toner particles are preferably obtained using an aggregation and coalescence method.

Specifically, for example, when the toner particles are produced using the aggregation and coalescence method, the toner particles are produced through a process of preparing a resin particle dispersion in which resin particles which become a binder resin are dispersed (resin particle dispersion preparing process), a process of forming aggregated particles by aggregating the resin particles (as necessary, other particles) in the resin particle dispersion (as necessary, in the dispersion after other particles are mixed) (aggregated particle forming process), and a process of forming toner particles by heating an aggregated particle dispersion in which the aggregated particles are dispersed to coalesce the aggregated particles (coalescing process).

Hereinafter, each process will be described in detail.

While a method of obtaining toner particles containing a colorant and a release agent will be described in the following description, the colorant and the release agent are used as necessary. Any additive other than colorants and release agents may, of course, be used.

Resin Particle Dispersion Preparing Process

First, along with a resin particle dispersion in which resin particles which become a binder resin are dispersed, for example, a colorant particle dispersion in which colorant particles are dispersed, and a release agent dispersion in which release agent particles are dispersed are prepared.

Herein, the resin particle dispersion is prepared, for example, by dispersing the resin particles in a dispersion medium by aid of a surfactant.

An example of the dispersion medium used in the resin particle dispersion includes an aqueous medium.

Examples of the aqueous medium include water such as distilled water and ion exchange water, and alcohols and the like. These may be used singly oz in combination of two or more kinds.

Examples of the surfactant include anionic surfactants such as sulfuric ester salts, sulfonates, phosphoric esters and soap surfactants; cationic surfactants such as amine salts and quaternary ammonium salts; and nonionic surfactants such as polyethylene glycol, alkylphenol ethylene oxide adducts and polyols. Among these, particularly, anionic surfactants and cationic surfactants are preferable. The nonionic surfactants may be used in combination with anionic surfactants or cationic surfactants.

The surfactants may be used singly or in combination of two or more kinds.

In the resin particle dispersions, the resin particles may be dispersed in the dispersion medium by a general dispersion method, for example, by using a rotary shear type homogenizer, or a ball mill, a sand mill or a dynomill having media. Further, depending on the kind of resin particles, the resin particles may be dispersed in the resin particle dispersion, for example, by phase inversion emulsification.

The phase inversion emulsification is a method in which a resin to be dispersed is dissolved in a hydrophobic organic solvent capable of dissolving the resin, a base is added to the organic continuous phase (O phase) to neutralize the resin, an aqueous medium (W phase) is added to invert the resin into a discontinuous phase: from W/O to O/W (so-called phase inversion), so that the resin may be dispersed in the form of particles in the aqueous medium.

The volume average particle size of the resin particles dispersed in the resin particle dispersions is preferably, for example, from 0.01 μm to 1 μm, more preferably from 0.08 μm to 0.8 μm, and even more preferably from 0.1 μm to 0.6 μm.

In addition, the volume average particle size of the resin particles is measured such that using the particle size distribution measured by a laser diffraction particle size distribution analyzer (for example, LA-700, manufactured by Horiba Seisakusho Co., Ltd.), a cumulative distribution is drawn from the small diameter side with respect to the volume based on the divided particle size ranges (channels) and the particle size at which the cumulative volume distribution reaches 50% of the total, particle volume is defined as a volume average particle size D50v. Hereinafter, the volume average particle size of particles in the other dispersion will be measured in the same manner.

For example, the content of the resin particles contained in the resin particle dispersion is preferably from 5% by weight to 50% by weight and more preferably from 10% by weight to 40% by weight.

For example, the colorant dispersion and the release agent dispersion may be prepared in a manner similar to the dispersion of resin particles. That is, with respect to the volume average particle size of the particles, the dispersion medium, the dispersion method and the content of the particles in the dispersion of the resin particles, the same is applied to the colorant particles dispersed in the colorant dispersion and the release agent particles dispersed in the release agent dispersion.

Aggregated Particle Forming Process

Next, along with the resin particle dispersion, the colorant particle dispersion and the release agent dispersion are mixed.

Then, in the mixed dispersion, the resin particles, the colorant particles and the release agent particles are heteroaggregated to form aggregated particles containing the resin particles, the colorant particles and the release agent particles, which have an approximately targeted particle size of the toner particle.

Specifically, for example, an aggregation agent is added to the mixed dispersion, and the pa of the mixed dispersion is adjusted to an acidic range (for example, from pH 2 to 5). As necessary, a dispersion stabilizer is added thereto, followed by heating to the glass transition temperature of the resin particles (specifically, from the temperature 30° C. lower than the glass transition temperature of the resin particles to the temperature 10° C. lower than the glass transition temperature). The particles dispersed in the mixed dispersion are aggregated to form aggregated particles.

In the aggregated particle forming process, for example, the aggregation agent is added to the mixed dispersion while stirring using a rotary shear type homogenizer at room temperature (for example, 25° C.), and the pH of the mixed dispersion is adjusted to an acidic range (for example, from pH 2 to 5). As necessary, a dispersion stabilizer may be added thereto, followed by heating.

Examples of the aggregation agent include a surfactant having a polarity opposite to the polarity of the surfactant used as the dispersant which is added to the mixed dispersion, for example, an inorganic metal salt and a divalent or higher-valent metal complex. In particular, when a metal complex is used as an aggregation agent, the amount of the surfactant used is reduced, which results in improvement of charging properties.

An additive capable of forming a complex or a similar bond with a metal ion in the aggregation agent may be used as necessary. As the additive, a chelating agent is suitable.

Examples of the inorganic metal salt include metal salts such as calcium chloride, calcium nitrate, barium chloride, magnesium chloride, zinc chloride, aluminum chloride and aluminum sulfate, and polymers of inorganic metal salts such as polyaluminum chloride, polyaluminum hydroxide and calcium polysulfide.

The chelating agent may be a water soluble chelating agent. Examples of the chelating agent include oxycarboxylic acids such as tartaric acid, citric acid and gluconic acid, iminodiacetic acid (IDA), nitrilotriacetic acid (NTA), and ethylenediaminetetraacetic acid (EDTA).

The amount of the chelating agent added is preferably from 0.01 part by weight to 5.0 parts by weight and more preferably 0.1 part by weight or more and less than 3.0 parts by weight with respect to 100 parts by weight of the resin particles.

Coalescing Process

Next, the aggregated particles are coalesced by heating the aggregated particle dispersion having the aggregated particles dispersed therein to, for example, the glass transition temperature of the resin particles (for example, 10° C. to 30° C. higher than the glass transition temperature of the resin particles) or higher, to form toner particles.

The toner particles are obtained by the above-described processes.

Further, the toner particles may be produced by a process of forming second aggregated particles by obtaining an aggregated particle dispersion having the aggregated particles dispersed therein, mixing the aggregated particle dispersion and the resin particle dispersion having the resin particles dispersed therein and further performing aggregation so as to attach the resin particles on the surface of the aggregated particles, and a process of coalescing the second aggregated particles by heating a second aggregated particle dispersion having the second aggregated particles dispersed therein to form toner particles having a core and shell structure.

After the coalescing process is completed, the toner particles formed in the solution are subjected to washing, solid-liquid separation and drying processes as known in the art to obtain dried toner particles.

The washing process may be preferably performed by a replacement washing with ion exchange water in terms of charging properties. The solid-liquid separation process is not particularly limited but may be preferably performed by filtration under suction or pressure in terms of productivity. The drying process is not particularly limited but may be preferably performed by freeze-drying, flash jet drying, fluidized drying or vibration fluidized drying in terms of productivity.

The toner according to the exemplary embodiment is produced, for example, by adding and mining the external additive to the obtained dried toner particles. The mixing may be preferably performed by a V blender, a Henschel mixer, a Lödige mixer and the like. Further, as necessary, coarse particles may be removed using a vibration sieve or a wind classifier.

Method of Attaching Nitrogen Atoms

In the exemplary embodiment, a method of setting the content of nitrogen atoms on the surfaces of the toner particles to the aforementioned range is not particularly limited.

For example, the nitrogen amount on the surface of the toner may be controlled by using a method of adding a nitrogen-containing material (for example, a specific organic compound described later) in the toner particle production step, or physically or chemically coating the outermost surface of the toner with a nitrogen-containing material after the toner particle production. Particularly, since the nitrogen amount in the depth direction of the toner particles needs to be controlled, a method of performing a surface treatment after the toner particle production is preferably used.

For example, a surface treatment may foe performed by a wet method such as a method in which, in a state in which the toner particles are dispersed in water, a cationic nitrogen-containing material is mixed with the toner particles and electrostatically attached to anions on the surfaces of the toner particles to be dried, a method in which functional groups such as carboxyl groups and hydroxyl groups present on the surfaces of the toner particles and nitrogen-containing functional groups such as amine and isocyanate are chemically bonded via a urethane bond, a urea bond, an amide bond and the like, or a method in which a nitrogen-containing compound is bonded to toner particles via an ester bond, an ether bond, or a covalent bond. As a dry method, for example, it is possible to perform a surface treatment of a nitrogen-containing compound on the toner particles using a surface treating apparatus represented as a HYBRIDIZATION SYSTEM, (manufactured by NARA MACHINERY CO., LTD.) and NOBILTA (manufactured by Hosokawa Micron Group). Particularly, in the method in which, in a state in which the toner particles are dispersed in water, a nitrogen-containing material is attached to the surfaces of the toner particles via electrostatical adsorption of cations and anions, even attachment may be achieved without causing a toner aggregation and therefore the method is preferable.

On the surfaces of the toner particles according to the exemplary embodiment, nitrogen atoms in the aforementioned range are present. The nitrogen scarce of the nitrogen atoms present on the surface of the toner particle is not particularly limited, but the source may be an organic compound of which the weight fraction of nitrogen atoms is from 5% to 50% (hereinafter, referred to as "a specific organic compound" in some cases).

Specific examples of the specific organic compound include polyethyleneimine, polyally amine, polyhexamethylene biguanide, alkyl diaminoethyl glycine and cationized cellulose.

In addition, the specific organic compound may have a structure in which the nitrogen source is present in the organic compound in the form of a mixture or impurities. For example, when polycyclohexyl methacrylate is synthesized by polymerization of cyclohexyl methacrylate, a compound obtained by making the polycyclohexyl methacrylate synthesized using nitrogen-containing polymerization initiator, such as azobisisobutyronitrile (AIBN), as a polymerization initiator, contain nitrogen may be used as the specific organic compound.

Among these, polyethyleneimine and polyallyl amine, which are water-soluble, are preferable from the viewpoint of uniformity in the treatment, and polyethyleneimine is more preferable.

In the exemplary embodiment, the weight fraction of nitrogen atoms in the specific organic compound, is calculated by the following method.

In the case where the chemical constitution of a compound A is represented as $C_xH_yO_zN_\alpha$, the weight fraction of nitrogen atoms in the compound A is represented as $\alpha\times14$ (nitrogen atom weight)/($x\times12$ (carbon atom weight)+$y\times1$ (hydrogen atom weight)+$Z\times16$ (oxygen atom weight)+$\alpha\times14$ (nitrogen atom weight)). Even when another element A is added to the weight fraction by $\beta$, the weight fraction of nitrogen atoms may be represented by adding $\beta\times$ an atomic weight of A to a denominator.

In addition, in the case in which a resin having a carbon-carbon double bond is used as the binder resin contained in the toner particles, the nitrogen atoms of the aforementioned range may be present on the surfaces of the toner particles by adding a nitrogen-containing polymerization initiator such as azobisisobutyronitrile in a state in which the toner particles are dispersed in water, and reacting the azobisisobutyronitrile with the surfaces of the toner particles.

Electrostatic Charge Image Developer

The electrostatic charge image developer according to the exemplary embodiment is a developer including at least the toner according to the exemplary embodiment.

The electrostatic charge image developer according to the exemplary embodiment may be a single-component developer containing only the toner according to the exemplary embodiment, or may be a two-component developer containing a mixture of the toner and a carrier.

There is no particular limitation to the carrier and known carriers may be used. Examples of the carrier include a coated carrier in which the surface of a core made of a magnetic powder is coated with a coating resin; a magnetic powder dispersed carrier in which a magnetic powder is dispersed and blended in a matrix resin; a resin impregnated carrier in which a porous magnetic powder is impregnated with a resin; and a resin dispersed carrier in which conductive particles are dispersed and blended in a matrix resin.

The magnetic powder dispersed carrier, resin impregnated carrier and conductive particle dispersed carrier may be carriers each having the constitutional particle of the carrier as a core and a coating resin coating the core.

Examples of the magnetic powder include magnetic metal such as iron oxide, nickel, or cobalt and a magnetic oxide such as ferrate and magnetite.

Examples of the conductive particles include metal particles of gold, silver and copper and the like, and particles of carbon black, titanium oxide, cine oxide, tin oxide, barium sulfate, aluminum borate, potassium titanate or the like.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene acrylic acid copolymer, a straight silicone resin containing an organosiloxane bond or a modified article thereof, a fluoro resin, polyester, polycarbonate, a phenol resin, and an epoxy resin.

Further, the coating resin and matrix resin may contain conductive materials and other additives and the like.

Here, in order to coat the surface of the core with the coating resin, a coating method using a coating resin and a coating layer forming solution in which various kinds of additives are dissolved in an appropriate solvent as necessary, may be used. The solvent is not particularly limited and may be selected depending on a coating resin to be used and application suitability.

Specific examples of the resin coating method include an dipping method including dipping a core in a coating layer forming solution, a spray method including spraying a coating layer forming solution to the surface of a core, a fluidized-bed method including spraying a coating layer forming solution to a core while the core is suspended by a fluidizing air, and a kneader coater method including mixing a core of a carrier with a coating layer forming solution in a kneader coater, and then removing the solvent.

In the two-component developer, a mixing ratio (weight ratio) of the toner and the carrier is preferably toner:carrier=1:100 to 30:100, and more preferably 3:100 to 20:100.

Image Forming Apparatus and Image Forming Method

Next, an image forming apparatus and an image forming method according to the exemplary embodiment will be described.

The image forming apparatus according to the exemplary embodiment includes an image holding member; a charging unit that charges the surface of the image holding member; an electrostatic charge image forming unit that forms an electrostatic charge image on a charged surface of the image holding member; a developing unit that accommodates an electrostatic charge image developer, and develops the electrostatic charge image formed on the surface of the image holding member as a toner image using the electrostatic charge image developer; a transfer unit that transfers the toner image formed on the surface of the image holding member onto the surface of a recording medium; and a fixing unit that fixes the toner image transferred onto the surface of the recording medium. As the electrostatic charge image developer, the electrostatic charge image developer according to the exemplary embodiment is used.

In the image forming apparatus according to the exemplary embodiment, there is carried out an image forming method (an image forming method according to the exemplary embodiment) including charging a surface of an image holding member; forming an electrostatic charge image on a charged surface of the image holding member; developing the electrostatic charge image formed on the surface of the image holding member as a toner image using the electrostatic charge image developer according to the exemplary embodiment; transferring the toner image formed on the surface of the image holding member onto the surface of a recording medium; and fixing the toner image transferred onto the surface of the recording medium.

As the image forming apparatus according to the exemplary embodiment, known image forming apparatuses such as a direct transfer type image forming apparatus which directly transfers a toner image formed on the surface of an image holding member onto a recording medium; an intermediate transfer type image forming apparatus which primarily transfers a toner image formed on the surface of an image holding member onto the surface of an intermediate transfer member and secondarily transfers the toner image transferred on the surface of the intermediate transfer member onto the surface of a recording medium; an image forming apparatus including a cleaning unit which cleans the surface of an image holding member before charged and after a toner image is transferred; and an image forming apparatus including an erasing unit which erases a charge from the surface of an image holding member before charged and after a toner image is transferred by irradiating the surface with easing light may be used.

In the case of the intermediate transfer type image forming apparatus, for example, a transfer unit includes an intermediate transfer member in which a toner image is transferred onto the surface, a primary transfer unit which primarily transfers the toner image formed on the surface of the image holding member onto the surface of the intermediate transfer member, and a secondary transfer unit which secondarily transfers the toner image transferred onto the surface of the intermediate transfer member onto the surface of a recording medium.

In the image forming apparatus according to the exemplary embodiment, for example, a portion including the developing unit may have a cartridge structure (process cartridge) which is detachable from the image forming apparatus. As the process cartridge, for example, a process cartridge which accommodates the electrostatic charge image developer according to the exemplary embodiment and is provided with the developing unit is suitably used.

Hereinafter, an example of the image forming apparatus according to the exemplary embodiment will be shown, however, there is no limitation thereto. In addition, main components shown in the drawing will be described, and the descriptions of the other components will be omitted.

FIG. 1 is a configuration diagram schematically showing an image forming apparatus according to an exemplary embodiment.

The image forming apparatus shown in FIG. 1 includes first to fourth electrophotographic image forming units (image forming units) 10Y, 10M, 10C, and 10K which output images or the respective colors including yellow (Y), magenta (M), cyan (C), and black (K) on the basis of color-separated image data. These image forming units (hereinafter, also referred to simply as "units" in some cases) 10Y, 10M, 10C and 10K are arranged horizontally in a line with predetermined distances therebetween. Incidentally, each of these units 10Y, 10M, 10C and 10K may be a process cartridge which is detachable from the image forming apparatus.

An intermediate transfer belt 20 is provided through each unit as an intermediate transfer member extending above each of the units 10Y, 10M, 10C and 10K in the drawing. The intermediate transfer belt 20 is provided around a drive roller 22 and a support roller 24 coming into contact with the inner surface of the intermediate transfer belt 20, which are separated from each other from left to right in the drawing. The intermediate transfer belt 20 travels in a direction from the first unit 10Y to the fourth unit 10K. Incidentally, the support roller 24 is pushed in a direction of separation from the drive roller 22 by a spring or the like (not shown), such that tension is applied to the intermediate transfer belt 20 which is provided around the support roller 24 and the drive roller 22. Also, on the surface of the image holding member side of the intermediate transfer belt 20, an intermediate transfer member cleaning device 30 is provided opposing the drive roller 22.

Also, toners in the four colors of yellow, magenta, cyan and black, which are accommodated in toner cartridges 8Y, 8M, 8C and 8K, respectively, are supplied to developing devices (developing units) 4Y, 4M, 4C and 4K of the above-described units 10Y, 10M, 10C and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example. In addition, the same components as those of the first unit 10Y are represented by reference numerals to which the symbols M (magenta), C (cyan), and K (black) are attached instead of the symbol Y (yellow), and the descriptions of the second to fourth units 10M, 10C, and 10K, will be omitted.

The first unit 10Y includes a photoreceptor 1Y functioning as the image holding member. In the surroundings of the photoreceptor 1Y, there are successively disposed a charging roller 2Y (an example of the charging unit) for charging the surface of the photoreceptor 1Y to a predetermined potential; an exposure device 3 (an example of the electrostatic charge image forming unit) for exposing the charged surface with a laser beam 3Y on the basis of a color-separated image signal to form an electrostatic charge image; the developing device 4Y (an example of the developing unit) for supplying a charged toner into the electrostatic charge image to develop the electrostatic charge image; a primary transfer roller 5Y (an example of the primary transfer unit) for transferring the developed toner image onto the intermediate transfer belt 20; and a photoreceptor cleaning device 61 (an example of the cleaning unit) for removing the toner remaining on the surface of the photoreceptor 1Y after the primary transfer.

The primary transfer roller 5Y is disposed inside the intermediate transfer belt 20 and provided opposite to the photoreceptor 1Y. Furthermore, bias power supplies (not shown), which apply primary transfer biases, are respectively connected to the respective primary transfer rollers 5Y, 5M, 5C and 5K. A controller (not shown) controls the respective bias power supplies to change the primary transfer biases which are applied to the respective primary transfer rollers.

Hereinafter, the operation of forming a yellow image in the first unit 10Y will be described.

First, before the operation, the surface of the photoreceptor 1Y is charged to a potential of −600 V to −800 V by the charging roller 2Y.

The photoreceptor 1Y is formed by stacking a photosensitive layer on a conductive substrate (volume resistivity at 20° C.: $1\times10^{-6}$ Ωcm or lower). In general, this photosensitive layer has high resistance (resistance similar to that of general resin), and has properties in which, when irradiated with the laser beam 3Y, the specific resistance of a portion irradiated with the laser beam changes. Therefore, the laser beam 3Y is output to the charged surface of the photoreceptor 1Y through the exposure device 3 in accordance with yellow image data sent from the controller (not shown). The photosensitive layer on the surface of the photoreceptor 1Y is irradiated with the laser beam 3Y, As a result, an electrostatic charge image having a yellow printing pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charged charge flows on the surface of the photoreceptor 1Y and, in contrast, when the charge remains in a portion which is not irradiated with the laser beam 3Y.

The electrostatic charge image which is formed on the photoreceptor 1Y in this manner is rotated to a predetermined development position along with the travel, of the photoreceptor 1Y. At this development position, the electrostatic charge image on the photoreceptor 1Y is visualized (developed) as a toner image by the developing device 4Y.

The developing device 4Y accommodates, for example, the electrostatic charge image developer, which contains at lease a yellow toner and a carrier. The yellow toner is frictionally charged by being stirred in the developing device 41 to have a charge with the same polarity (negative polarity) as that of a charge charged on the photoreceptor 1Y and is maintained on a developer roller (as an example of the developer holding member). When the surface of the photoreceptor 1Y passes through the developing device 4Y, the yellow toner is electrostatically attached to a latent image portion at which the charge is erased from the surface of the photoreceptor 1Y, and the latent image is developed with the yellow toner. The photoreceptor 1Y on which a yellow toner image is formed subsequently travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20, The transfer bias applied at this time has a (+) polarity opposite to the polarity (−) of the toner. For example, the first unit 10Y is controlled to +10 μA by the controller (not shown).

Meanwhile, the toner remaining on the photoreceptor 1Y is removed and collected by the photoreceptor cleaning device 6Y.

Also, primary transfer biases to be applied respectively to the primary transfer rollers 5M, 5C and 5K at the second unit 10M and subsequent units, axe controlled similarly to the primary transfer bias of the first unit.

In this manner, the intermediate transfer belt 20 having a yellow toner image transferred thereonto from the first unit 10Y is sequentially transported through the second to fourth units 10M, 10C and 10K, and toner images of respective colors are superimposed and multi-transferred.

The intermediate transfer belt 20 having the four toner images multi-transferred thereonto through the first to fourth units arrives at a secondary transfer portion which is configured with the intermediate transfer belt 20, the support roller 24 coming into contact with the inner surface of the intermediate transfer belt and a secondary transfer roller 26 (an example of the secondary transfer unit) disposed on the side of the image holding surface of the intermediate transfer belt 20. Meanwhile, a recording paper P (an example of the recording medium) is supplied to a gap at which the secondary transfer roller 26 and the intermediate transfer belt 20 are brought into contact with each other at a predetermined timing through a supply mechanism and a secondary transfer bias is applied to the support roller 24. The transfer bias applied at this time has the same (−) polarity as the polarity (−) of the toner, and an electrostatic force directing from the intermediate transfer belt 20 toward the recording paper P acts upon the toner image, whereby the toner image on the intermediate transfer belt 20 is transferred onto the recording paper P. Incidentally, on this occasion, the secondary transfer bias is determined depending upon a resistance detected by a resistance detecting unit (not shown) for detecting a resistance of the secondary transfer portion, and the voltage is controlled.

Thereafter, the recording paper P is sent to a press contact portion (nip portion) of a pair of fixing rollers in a fixing device 28 (an example of the fixing unit), and the toner image is fixed onto the recording paper P to form a fixed image.

Examples of the recording paper P onto which the toner image is transferred include plain paper used for electrophotographic copying machines, printers and the like. As the recording medium, other than the recording paper P, OHP sheets may be used.

In order to improve the smoothness of the image surface after the fixing, the surface of the recording paper P is preferably smooth, for example, coated paper in which the surface of plain paper is coated with a resin and the like, art paper for printing and the like are suitably used.

The recording paper P in which fixing of a color image is completed is transported to an ejection portion, whereby a series of the color image formation operations end.

Process Cartridge and Toner Cartridge

A process cartridge according to the exemplary embodiment will be described.

The process cartridge according to the exemplary embodiment includes a developing unit, which accommodates the electrostatic charge image developer according to the exemplary embodiment and develops an electrostatic charge image formed on an image holding member as a toner image using the electrostatic charge image developer, and is detachable from the image forming apparatus.

In addition, the configuration of the process cartridge according to the exemplary embodiment is not limited thereto and may include a developing device and, additionally, one selected from other units such as an image holding member, a charging unit, an electrostatic charge image forming unit and a transfer unit as necessary.

Hereinafter, an example of the process cartridge according to the exemplary embodiment will be shown and the process cartridge is not limited, thereto. Main parts shown in the drawing will be described and the descriptions of other parts will be omitted.

Figure 2:
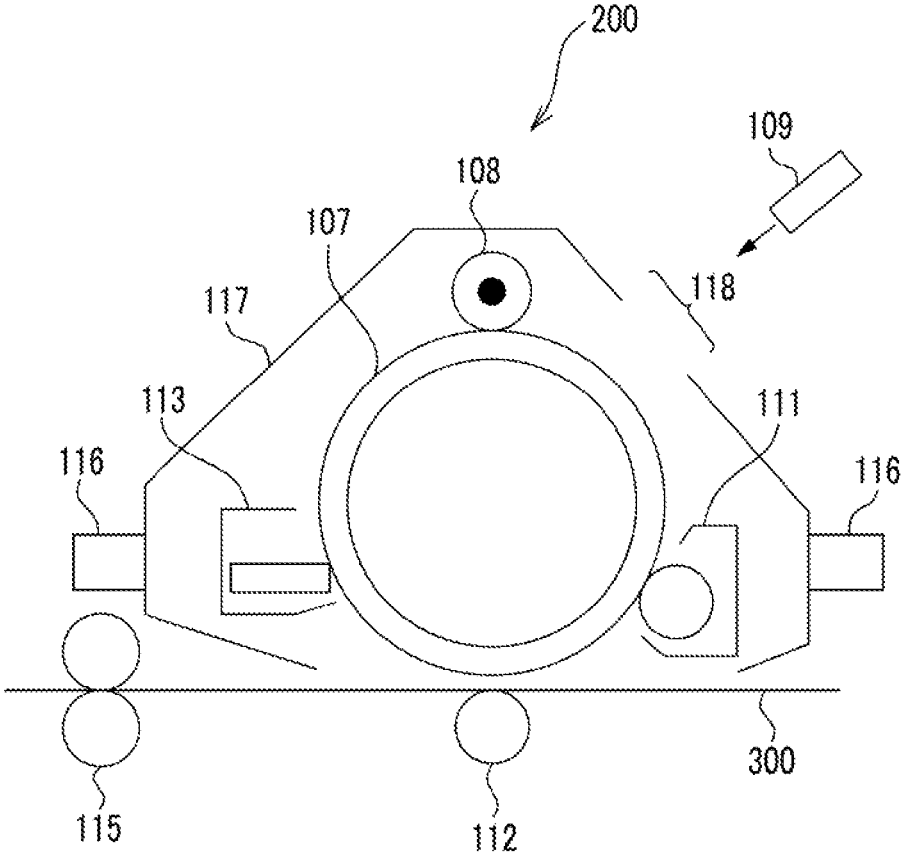
FIG. 2 is a configuration diagram schematically showing an example of a process cartridge according to an exemplary embodiment.

FIG. 2 is a configuration diagram schematically showing a process cartridge according to an exemplary embodiment.

A process cartridge 200 shown in FIG. 2 includes, a photoreceptor 107 tan example of the image holding member), a charging roller 108 (an example of the charging unit), a developing device 111 (an example of the developing unit) and a photoreceptor cleaning device 113 (an example of the cleaning unit) provided in the periphery of the photoreceptor 107, all of which are integrally combined and supported, for example, by a housing 117 provided with a mounting rail 116 and an opening portion 118 for exposure to form a cartridge.

Then, in FIG. 2, 109 denotes an exposure device (an example of the electrostatic charge image forming unit), 112 denotes a transfer device (an example of the transfer unit), 115 denotes a fixing device (an example of the fixing unit), and 300 denotes recording paper (an example of the recording medium).

Next, a toner cartridge according to the exemplary embodiment will be described.

The toner cartridge according to the exemplary embodiment is a toner cartridge which is detachable from the image forming apparatus and accommodates the electrostatic charge image developing toner according to the exemplary embodiment therein. The toner cartridge accommodates the electrostatic charge image developing toner for replenishment in order to supply the toner to the developing unit provided in the image farming apparatus.

The image forming apparatus shown in FIG. 1 is an image forming apparatus having a configuration in which the toner cartridges 8Y, 8M, 8C and 8K are detachably attached, and the developing devices 4Y, 4M, 4C, and 4K are connected to toner cartridges corresponding to the respective developing devices (colors) via a toner supply line (not shown). Also, in the case where the toner accommodated in the toner cartridge runs low, the toner cartridge is replaced.

EXAMPLES

The exemplary embodiments are more specifically described below with reference to the following Examples, but it should be construed that the exemplary embodiments are not limited to these Examples. Incidentally, in the following description, "parts" and represent "parts by weight" and "% by weight", respectively unless otherwise indicated.

Preparation of Amorphous Polyester Resin Particle Dispersion (A)

Dimethyl terephthalate: 116 parts
Dimethyl fumarate: 22 parts
Dodecenyl succinic anhydride: 53 parts
Trimellitic anhydride: 10 parts
Bisphenol A ethylene oxide 2-mol adduct: 110 parts
Bisphenol A propylene oxide 2-mol adduct: 220 parts The aforementioned components are put in a reaction container having a stirrer, a thermometer, a condenser and a nitrogen gas introduction tube. The reaction container is purged with dry nitrogen gas and then, 2.7 parts of tin dioctanoate is added as a catalyst. The reaction of the mixture is conducted at 195° C. for 6 hours under nitrogen gas flow white the mixture is stirred. The resultant is then heated to 240° C. and the reaction is conducted for 6.0 hours while the resultant is stirred. The pressure within the reaction container is decreased to 10.0 mmHg. The reaction of the resultant is conducted for about 0.5 hours under the reduced pressure while the resultant is stirred. Thus, an amorphous polyester resin A that is yellow and transparent is obtained.

Next, the obtained amorphous polyester resin A is dispersed using a dispersing machine obtained by modifying a Cavitron CD 1010 (manufactured by EUROTEC LIMITED) into a high temperature and high pressure type. The CAVITRON is operated at a composition ratio of 80% of ion exchange water and 20% of the polyester resin, with the pH being adjusted to 8.5 with ammonia, and under the conditions of a rotation rate of a rotor of 60 Hz, a pressure of 5 $Kg/m^2$, and a temperature of 140° C. by heating using a heat exchanger; as a result, an amorphous polyester resin dispersion A (solid content: 20%) is obtained.

The weight average molecular weight of the obtained amorphous polyester resin A is 105,000, the glass transition temperature is 58.2° C., and the average particle size of the amorphous polyester resin dispersion A is 0.168 μm.

Preparation of Amorphous Polyester Resin Particle Dispersion (B)

Dimethyl terephthalate: 87 parts
Dimethyl fumarate: 65 parts
Dodecenyl succinic anhydride: 26 parts
Bisphenol A ethylene oxide 2-mol abduct: 63 parts
Bisphenol A propylene oxide 2-mol adduct: 275 parts The aforementioned components are out in a reaction container having a stirrer, a thermometer, a condenser and a nitrogen gas introduction tube. The reaction container is purged with dry nitrogen gas and then, 2.5 parts of tin dioctanoate is added as a catalyst. The reaction of the mixture is conducted at 195° C. for 5 hours under nitrogen gas flow while the mixture is stirred. The resultant is then heated to 240° C. and the reaction, is conducted for 4.0 hours while the resultant is stirred. The pressure within the reaction container is decreased to 10.0 mmHg. The reaction of the resultant is conducted for about 0.5 hours under the reduced pressure while the resultant is stirred. Thus, an amorphous polyester resin B that is yellow and transparent is obtained.

Next, the obtained amorphous polyester resin B is dispersed using a dispersing machine obtained by modifying a Cavitron CD 1010 (manufactured by EUROTEC LIMITED) into a high temperature and high pressure type. The CAVITRON as operated at a composition ratio of 80% of ion exchange water and 20% of the polyester resin, with the pH being adjusted to 8.5 with ammonia, and under the conditions of a rotation rate of a rotor of 60 Hz, a pressure of 5 $Kg/cm^2$, and a temperature of 140° C. by heating using a heat exchanger; as a result, an amorphous polyester resin dispersion B (solid content: 20%) is obtained.

The weight average molecular weight of the obtained amorphous polyester resin B is 25,000, the glass transition temperature is 63.4° C., and the average particle size of the amorphous polyester resin dispersion B is 0.142 μm.

Preparation of Styrene-n-butyl-acrylate Resin.

The mixture in which 370 parts of styrene, 30 parts of n-butyl acrylate, 8 parts of acrylic acid, 24 parts of dodecanethiol, and 4 parts of carbon tetrabromide are mixed and dissolved is added to a flask containing a solution in which 6 parts of a nonionic surfactant (NONIPOL 400, manufactured by Sanyo Chemical Industries, Ltd.) and 10 parts of an anionic surfactant (NEOGEN SC, manufactured by Dai-ichi Kogyo Seiyaku Co., Ltd.) are dissolved in 550 parts of ion exchange water, and the mixture is subjected to emulsion polymerization. 50 parts of ion exchange water in which 4 parts of ammonium persulfate is dissolved is added to the mixture while the mixture is mixed gently for 10 minutes. After the flask is purged with nitrogen, the mixture is heated to 70° C. in an oil bath while the mixture in the flask is stirred and the emulsion polymerization continues for 5 hours as it is. As a result, a styrene-n-butyl-acrylate resin dispersion having a volume average particle size of 150 nm and a solid content concentration of 35% is obtained. When the obtained styrene-n-butyl-acrylate resin dispersion is dried, the weight average molecular weight is 11,500 and the glass transition temperature is 58° C.

Preparation of Release Agent Dispersion

Paraffin wax HNP 9 (manufactured by Nippon Seiro Co., Ltd., melting temperature: 74° C., specific gravity: 0.925 g/cm$^3$): 45 parts Anionic surfactant (NEOGEN RK, manufactured by Dai-ichi Kogyo Seiyaku Co., Ltd.): 5 parts Ion exchange water: 200 parts The aforementioned components are heated to 95° C. and dispersed using a homogenizer (ULTRA TURRAX T50, manufactured by IKA Works, Inc.) and then dispersed by a high pressure gaulin homogenizer (manufactured by APV GAULIN, INC.) thereby preparing a release agent dispersion (release agent concentration: 20%) having a volume average particle size of 0.21 μm.

Preparation of Black Pigment Dispersion

Black pigment (#25, manufactured by Mitsubishi Chemical Co., Ltd., primary particle size: 0.047 μm): 100 parts Anionic surfactant (NEOGEN R, manufactured by Dai-ichi Kogyo Seiyaku Co., Ltd.): 15 parts Ion exchange water: 400 parts The aforementioned components are mixed, dissolved and dispersed for 1 hour using a high pressure impact type dispersing machine, ULTIMIZER (HJP30006, manufactured by Sugino Machine Ltd.), thereby preparing a black pigment dispersion having a volume average particle size of 0.35 μm. The pigment concentration of the dispersion is 23%.

Example 1

Production of Toner Particles 1

Amorphous polyester resin dispersion A: 138 parts

Amorphous polyester resin dispersion B: 138 parts

Release agent dispersion: 45 parts

Black pigment dispersion: 26 parts

The aforementioned components are put into a round-bottomed stainless steel flask and mixed and dispersed using a homogenizer (ULTRA TURRAX T50, manufactured by IKA Works, Inc.). Then, 1% aluminum sulfate aqueous solution is added, to the dispersion as an aggregation agent and the dispersion operation continues using the ULTRA TURRAX.

A stirrer and a mantle heater are provided and the slurry is heated to 40° C. at 0.5° C./min while the number of rotations of the stirrer is adjusted, so as to stir the slurry sufficiently. The slurry is kept at 40° C. for 15 minutes and then, is heated at 0.05° C./min while the particle size is measured at 10-minute intervals. When a desired volume average particle size is obtained, 150 parts of an additional amorphous polyester resin dispersion (mixture of 75 parts of the amorphous polyester resin dispersion A and 75 parts of the amorphous polyester resin dispersion B) is introduced over 3 minutes into the slurry. After introduction, the slurry is kept for 30 minutes and then adjusted to pH 8.0 with 5% aqueous sodium hydroxide solution. Thereafter, the slurry is adjusted to pH 8.0 with each rise of 5° C. and the temperature is increased to 90° C. at a rate of 1° C./min and then kept at 90° C. The slurry is measured every 30 minutes for particle shape and surface property with an optical microscope and a scanning electron microscope (FE-SEM). After the aggregated particles are coalesced sufficiently, the particles are cooled with ice water thereby solidifying the particles.

Thereafter, the product is filtered and washed with ion exchange water to obtain toner particles in a wet cake state.

The obtained toner particles in a wet cake state are redispersed in ion exchange water so as to have a solid content concentration of 10%. While the dispersion is stirred, a 1% aqueous solution of polyethyleneimine 70,000 (polyethyleneimine, weight fraction of nitrogen atoms: 33%, manufactured by Junsei Chemical Co., Ltd.) corresponding to 0.05% with respect to the solid, content weight of the toner particles is added over 5 minutes. After the addition, the pH is adjusted to 6.5±0.5 using 1 N nitric acid and stirring is performed for 2 hours at room temperature. After the stirring is completed, the dispersion is filtered, washed with ion exchange water and then, dried using a vacuum dryer thereby obtaining toner particles 1.

Regarding surface-treated toner particles, the content of nitrogen atoms on the surfaces of the toner particles and the content of nitrogen atoms at a depth of 10 nm inside from the surfaces of the toner particles, measured by X-ray photoelectron spectroscopy, are measured by the above-described method. The obtained result is shown in Table 1.

1 part of hydrophobic positive silica particles (TG820F, manufactured by Cabot Corporation) is added to 100 parts of the toner particles of which the surface is treated as described above, and externally added and mixed using a Henschel mixer to obtain a toner 1. Even when the external additive is removed from the toner 1 using the aforementioned method, and then, the content of nitrogen atoms is measured, the content is almost identical with the value before the external addition. Therefore, the values before the external addition are shown in Table 1.

Evaluation

A Docu Print P300d (manufactured by Fuji Xerox Co., Ltd.) is filled with the toner 1 and the toner is kept in the environment of 32° C. and 90% RH for 72 hours.

After the toner is kept, an image pattern having a solid image with a sire of 2.5 cm×2.5 cm at 3 places is continuously formed on 500 pieces of P paper (manufactured by Fuji Xerox Co., Ltd.). After the 500 image outputs, the solid image (toner applying amount: 4.0 to 4.5 g/m$^2$) is formed on the entire surface.

In total 3 places of the center of the solid image of the entire surface and locations respectively 20 mm from both end portions in a longitudinal direction, image density is measured using an X-Rite 938 (manufactured by X-Rite, Inc.). The density is an average value (SAD1) of the 3 places. A degree of unevenness in the solid image is evaluated with a difference (ΔSAD1) between the maximum value and the minimum value among the measured values at the 3 places based on the following criteria. The obtained result is shown in Table 1.

Further, with respect to a degree of fogging, the maximum value (SAD2) of the image density in white portions in 1st, 250th and 500th output images of the image pattern having a solid image with a size of 2.5 cm×2.5 cm at 3 places is evaluated based on the following criteria. The obtained result is shown in Table 1.

Solid Image density

A: SAD1 is equal to or more than 1.4

B: SAD1 is equal to or more than 1.2 and less than 1.4

C: SAD1 is less than 1.2

Solid Image Unevenness

A: ΔSAD1 is equal to or less than 0.1

B: ΔSAD1 is more than 0.1 and equal to or less than 0.15

C: ΔSAD1 is more than 0.15

Fogging

A: SAD2 is equal to or less than 0.02

B: SAD2 is more than 0.02 and equal to or less than 0.03

C: SAD2 is more than 0.03

Example 2

After toner particles in a wet cake state are obtained in the same manner as in Example 1, the toner particles are redispersed in ion exchange water so as to have a solid content concentration of 5%. While the dispersion is stirred, a 5% aqueous solution of cationized cellulose (POISE C150L, hydroxyethylcellulose hydroxylpropyl trimethylammonium, chloride ether, weight fraction of nitrogen atoms; 1.2%, manufactured by Kao Corporation) corresponding to 1.5% with respect to the solid content weight of the toner particles is added over 5 minutes. After the addition, the pH is adjusted to 6.5±0.5 using 1 N nitric acid and stirring is performed for 2 hours at room temperature. After the stirring is completed, the dispersion is filtered, washed with ion exchange water and then, dried using a vacuum dryer thereby obtaining toner particles 2.

An external addition treatment is performed in the same manner as the toner 1 to obtain a toner 2.

The obtained toner 2 is evaluated in the same manner as in Example 1. The evaluation result is shown in Table 1.

Example 3

After toner particles in a wet cake state are obtained in the same manner as in Example 1, the toner particles are redispersed in ion exchange water so as to have a solid content, concentration of 10%, While the dispersion is stirred, a 5% aqueous solution of a polyallylamine hydrochloride polymer (PAA-HCL-10L, weight fraction of nitrogen atoms: 15%, manufactured by NITTOBO MEDICAL CO., LTD.) corresponding to 0.2% with respect to the solid content weight of the toner particles is added over 5 minutes. After the addition, the pH is adjusted to 6.5±0.5 using 1 N nitric acid and stirring is performed for 2 hours at room temperature. After the stirring is completed, the dispersion is filtered, washed with ion exchange water and then, dried using a vacuum dryer thereby obtaining toner particles 3.

An external addition treatment is performed in the same manner as the toner 1 to obtain a toner 3.

The obtained toner 3 is evaluated in the same manner as in Example 1. The evaluation result is shown in Table 1.

Example 4

Styrene-n-butyl-acrylate resin dispersion: 157 parts

Release agent dispersion: 45 parts

Black pigment dispersion: 26 parts

The aforementioned components are put, mixed and dispersed in a round-bottomed stainless steel flask using a homogenizer (ULTRA TURRAX T50, manufactured by IKA Works, Inc.). Then, 0.8% aluminum sulfate aqueous solution is added to the dispersion as an aggregation agent and the dispersion operation continues using the ULTRA TURRAX.

A stirrer and a mantle heater are provided and the slurry is heated to 40° C. at 0.5° C./min while the number of rotations of the stirrer is adjusted so as to stir the slurry sufficiently. The slurry is kept at 40° C. for 15 minutes and then, is heated at 0.05° C./min while the particle size is measured at 10-minute intervals. When a desired volume average particle size is obtained, 85 parts of an additional styrene-n-butyl-acrylate resin dispersion is introduced over 3 minutes into the slurry. After introduction, the slurry is kept for 30 minutes and then adjusted to pH 7.0 with 5% aqueous sodium hydroxide solution. Thereafter, the slurry is adjusted to pH 7.0 with each rise of 5° C. and the temperature is increased to 96° C. at a rate of 1° C./min and then kept at 96° C. The slurry is measured every 30 minutes for particle shape and surface property with an optical microscope and a scanning electron microscope (FE-SEM). After the aggregated particles coalesce sufficiently, the particles are cooled with ice water thereby solidifying the particles.

Thereafter, the product is filtered and washed with ion exchange water to obtain toner particles in a wet cake state.

The obtained toner particles in a wet cake state are redispersed in ion exchange water so as to have a solid content concentration of 10%. While the dispersion is stirred, a 1% aqueous solution of polyethyleneamine 70,000 (manufactured by Junsei Chemical Co., Ltd.) corresponding to 0.035% with respect to the solid content weight of the toner particles is added over 5 minutes. After the addition, the pH is adjusted to 6.5±0.5 using 1 N nitric acid and stirring is performed for 2 hours at room temperature. After the stirring is completed, the dispersion is filtered, washed with ion exchange water and then, dried using a vacuum dryer thereby obtaining toner particles 4.

An external addition treatment is performed in the same manner as the toner 1 to obtain a toner 4.

The obtained toner 4 is evaluated in the same manner as in Example 1. The evaluation result is shown in Table 1.

Example 5

After toner particles in a wet cake state are obtained in the same manner as in Example 1, the toner particles are redispersed in ion exchange water so as to have a solid content concentration of 10%. While the dispersion is stirred, a 5% aqueous solution of cationized cellulose (POISE C150L, manufactured by Kao Corporation) corresponding to 2.5% with respect to the solid content weight of the toner particles is added, over 5 minutes. After the addition, the pH is adjusted to 6.5±0.5 using 1 N nitric acid and stirring is performed for 2 hours at room temperature. After the stirring is completed, the dispersion is filtered, washed with ion exchange water and then, dried using a vacuum dryer thereby obtaining toner particles 5.

An external addition treatment is performed in the same manner as the toner 1 to obtain a toner 5.

The obtained toner 5 is evaluated in the same manner as in Example 1. The evaluation result is shown in Table 1.

Example 6

After toner particles in a wet cake state are obtained in the same manner as in Example 1, the toner particles are redispersed in ion exchange water so as to have a solid content concentration of 5%. While the dispersion is stirred, the dispersion is heated to 75° C. At the time of reaching 75° C., a 1% aqueous solution of a nitrogen-containing polymerization initiator (trade name: V-50 (2,2'-azobis(2-methylpropionamidine)dihydrochloride, weight fraction of nitrogen atoms: 31%, manufactured by Wako Pure Chemical Industries, Ltd.) corresponding to 0.5% with respect to the solid content of the toner is added drop-wise and then, the reaction is conducted for 4 hours. After the reaction is completed, the dispersion is filtered, washed with ion exchange water and then, dried using a vacuum dryer thereby obtaining toner particles 6.

An external addition treatment is performed in the same manner as the toner 1 to obtain a toner 6.

The obtained toner 6 is evaluated in the same manner as in Example 1. The evaluation result is shown in Table 1.

Example 7

120 parts of cyclohexyl methacrylate, 193 parts of ion exchange water, 8.4 parts of a 20% aqueous solution of a cationic surfactant (Quartamine 86P Conc, manufactured by Kao Corporation), and 40.5 parts of a 1% aqueous solution of a nitrogen-containing polymerization initiator (trade name; V-50, manufactured by Wako Pure Chemical Industries, Ltd.) are mixed, and the mixture is mixed and dispersed using a homogenizer (ULTRA TURRAX T50, manufactured by IKA Works, Inc.) to produce an emulsified liquid.

820 parts of ion exchange water is put in a reaction container having a Dimroth condenser tube and capable of nitrogen introduction and nitrogen bubbling is conducted for 2 hours while the ion exchange water is heated to 70° C. Then, 18 parts of the emulsified liquid corresponding to 5% of the emulsified liquid is added dropwise. After the drop-wise addition, the resultant is kept for 30 minutes, and then, the remained emulsified liquid is added dropwise over 3 hours. After the dropwise addition, the temperature is increased to 85° C., and kept for 3 hours to conduct the reaction. Thereby, a polycyclohexyl methacrylate resin dispersion is obtained. The obtained dispersion is frozen and dried to obtain polycyclohexyl methacrylate resin particles (CHMA) having a volume average particle size of 80 nm.

After toner particles obtained by drying toner particles in a wet cake state obtained in the same manner as in Example 1 using a vacuum drier and the polycyclohexyl methacrylate resin particles corresponding to 1.5% with respect to the toner particles are mixed, the mixture is subjected to a dry treatment (3,000 rpm, 15 minutes) with a NOBILTA (manufactured by Hosokawa Micron Group), thereby obtaining toner particles 7 having polycyclohexyl methacrylate resin coat on the surfaces of the toner particles.

An external addition treatment is performed in the same manner as the toner 1 to obtain a toner 7.

The obtained toner 7 is evaluated in the same manner as in Example 1. The evaluation result is shown in Table 1.

Example 8

Amorphous polyester resin A: 27 parts

Amorphous polyester resin B: 60 parts

Paraffin wax HNP9: 7 parts

Black pigment (125, manufactured by Mitsubishi Chemical Co., Ltd.,): 0 parts

The powders of the aforementioned components are mixed with a Henschel mixer, and the mixture is thermally kneaded with a biaxial extrusion, kneader (set temperature: 200° C. After cooling, the kneaded mixture is coarsely pulverized with a hamster mill, finely milled with a jet mill, and classified with an air classifier to obtain toner particles.

The obtained toner particles are dispersed in a 5% aqueous solution of an anionic surfactant (NEOGEN R, manufactured by Dai-ichi Kogyo Seiyaku Co., Ltd.), filtered and washed with ion exchange water to obtain toner particles in a wet cake state. The obtained toner particles in a wet cake state are redispersed in ion exchange water so as to have a solid content concentration of 10%. While the dispersion is stirred, a 1% aqueous solution of polyethyleneimine 70,000 (manufactured by Junsei Chemical Co., Ltd.) corresponding to 0.08% with respect to the solid content weight of the toner particles is added over 5 minutes. After the addition, the pH is adjusted to 6.5±0.5 using 1 K nitric acid and stirring is performed, for 2 hours at room temperature. After the stirring is completed, the dispersion is filtered, washed with ion exchange water and then, dried using a vacuum dryer thereby obtaining toner particles 8.

An external addition treatment is performed in the same manner as the toner 1 to obtain a toner 8.

The obtained toner Sis evaluated in she same manner as in Example 1. The evaluation result is shown in Table 1.

Comparative Example 1

A toner 9 is obtained in the same operation as in Example 1 except that the amount of polyethyleneimine 70,000 used for treatment is changed to 0.01% with respect to the toner particles.

The obtained toner 9 is evaluated in the same manner as in Example 1. The evaluation result is shown in Table 1.

Comparative Example 2

A toner 10 is obtained in the same operation as in Example 3 except that the amount of polyallylamine hydrochloride used for treatment is changed to 0.3% with respect to the toner particles.

The obtained toner 10 is evaluated in the same manner as in Example 1. The evaluation result is shown in Table 1.

Comparative Example 3

A toner 11 is obtained in the same operation as in Example 7 except that the amount of polycyolohexyl methacrylate resin particles added is changed to 7.8% with respect to the toner particles.

The obtained toner 11 is evaluated in the same manner as in Example 1. The evaluation result is shown in Table 1.

TABLE 1

| | Configuration | | | Evaluation | | |
|---|---|---|---|---|---|---|
| | Surface N amount atomic % | Depth N amount atomic % | Nitrogen source | Solid image density | Solid image unevenness | Fogging |
| Example 1 | 3.5 | 0.25 | Polyethyleneimine | A | A | A |
| Example 2 | 0.8 | 0.30 | Cationized cellulose | B | B | A |
| Example 3 | 5.0 | 0.35 | Polyallyl amine | B | A | B |
| Example 4 | 2.5 | 0.12 | Polyethyleneimine | A | B | A |

TABLE 1-continued

| | Configuration | | | Evaluation | | |
|---|---|---|---|---|---|---|
| | Surface N amount atomic % | Depth N amount atomic % | Nitrogen source | Solid image density | Solid image unevenness | Fogging |
| Example 5 | 1.2 | 0.40 | Cationized cellulose | B | B | A |
| Example 6 | 2.8 | 0.22 | N-containing polymerization initiator | B | A | A |
| Example 7 | 2.2 | 0.10 | CHMA | A | B | A |
| Example 8 | 3.0 | 0.18 | Polyethyleneimine | B | B | B |
| Comparative Example 1 | 0.6 | 0.25 | Polyethyleneimine | B | C | A |
| Comparative Example 2 | 5.5 | 0.40 | Polyallyl amine | A | A | C |
| Comparative Example 3 | 3.0 | 0.50 | CHMA | C | A | B |

In Table 1, the surface N amount refers to "the content of nitrogen atoms on the surfaces of the toner particles measured by X-ray photoelectron spectroscopy", and the depth K amount refers to "the content of nitrogen atoms at a depth of 10 nm inside from the surfaces of the toner particles measured by X-ray photoelectron spectroscopy".

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the are. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles; and an external additive that is externally added to surfaces of the toner particles, wherein a content of nitrogen atoms on the surfaces of the toner particles is from 0.8 atomic % to 5.0 atomic % and a content of nitrogen atoms at a depth of 10 nm inside from the surfaces of the toner particles is 0.4 atomic % or less when measured by X-ray photoelectron spectroscopy.

2. The electrostatic charge image developing toner according to claim 1, wherein an organic compound of which the weight fraction of nitrogen atoms is from 5% to 50% is provided on the surfaces of the toner particles.

3. The electrostatic charge image developing toner according to claim 2, wherein the organic compound is polyethyleneimine.

4. The electrostatic charge image developing toner according to claim 1, wherein the toner particles contain a hinder resin having a carbon-carbon double bond, and the surfaces of the toner particles react with a nitrogen-containing polymerization initiator.

5. The electrostatic charge image developing toner according to claim 4, wherein the nitrogen-containing polymerization initiator is azobisisobutyronitrile.

6. The electrostatic charge image developing toner according to claim 4, wherein the binder resin contains a polyester resin.

7. The electrostatic charge image developing toner according to claim 6, wherein a glass transition temperature (Tg) of the polyester resin is from 50° C. to 80° C.

8. The electrostatic charge image developing toner according to claim 6, wherein a weight average molecular weight (Mw) of the polyester resin is from 5,000 to 1,000,000.

9. The electrostatic charge image developing toner according to claim 6, wherein a molecular weight distribution Mw/Mn of the polyester resin is from 1.5 to 100.

10. The electrostatic charge image developing toner according to claim 1, wherein the toner particles contain a colorant, and a content of the colorant is from 3% by weight to 15% by weight.

11. The electrostatic charge image developing toner according to claim 1, wherein the toner particles contain a release agent, and a melting temperature of the release agent is from 50° C. to 110° C.

12. The electrostatic charge image developing toner according to claim 1, wherein a volume average particle size (D50v) of the toner particles is from 2 μm to 10 μm.

13. The electrostatic charge image developing toner according to claim 1, wherein a shape factor SF1 of the toner particle is from 110 to 150.

14. The electrostatic charge image developing toner according to claim 1, wherein an amount of the external additive externally added is from 0.01% by weight to 5% by weight with respect to the toner particles.

15. An electrostatic charge image developer comprising the electrostatic charge image developing toner according to claim 1.

16. A toner cartridge that accommodates the electrostatic charge image developing toner according to claim 1 and is detachable from an image forming apparatus.

* * * * *